US005969686A

United States Patent [19]

Mackenzie

[11] Patent Number: 5,969,686

[45] Date of Patent: Oct. 19, 1999

[54] RETRACTABLE FORWARD LOOKING RADOME FOR AIRCRAFT

[75] Inventor: S. Benjamin Mackenzie, Rootstown, Ohio

[73] Assignee: Norton Performance Plastics Corporation, Wayne, N.J.

[21] Appl. No.: 08/772,542

[22] Filed: Dec. 24, 1996

[51] Int. Cl.[6] ..... H01Q 1/28

[52] U.S. Cl. ..... 343/705; 343/872

[58] Field of Search ..... 343/705, 708, 343/872, 915

[56] References Cited

U.S. PATENT DOCUMENTS

| | | | |
|---|---|---|---|
| 3,656,164 | 4/1972 | Rempt | 343/705 |
| 3,754,267 | 8/1973 | Walters et al. | 343/705 |
| 3,766,561 | 10/1973 | Johnson | 343/705 |
| 3,972,045 | 7/1976 | Perret | 343/705 |
| 3,982,250 | 9/1976 | Giannatto et al. | 343/872 |
| 3,984,837 | 10/1976 | Tatnall | 343/705 |
| 4,509,709 | 4/1985 | Utton et al. | 343/705 |
| 4,593,288 | 6/1986 | Fitzpatrick | 343/705 |

FOREIGN PATENT DOCUMENTS

| | | | |
|---|---|---|---|
| 2686981 | 1/1992 | France | H01Q 1/28 |
| 1492173 | 1/1977 | United Kingdom | H01Q 1/12 |
| 93/26058 | 12/1993 | WIPO | H01Q 1/34 |

OTHER PUBLICATIONS

Becker, R.J.; "Retractable Radome Houses Wide Dish"; *Microwaves*, 1972, p. 18.

Anon., "New Radomes Improve Radar Performance", *Fiberglass Facts*, No. 25, 1987, pp. 10–11.

*Primary Examiner*—Don Wong
*Assistant Examiner*—Tan Ho
*Attorney, Agent, or Firm*—Volker R. Ulbrich

[57] ABSTRACT

A retractable forward looking radome assembly which extends from a recess in the undersurface of the aircraft is provided for housing and protecting one or more radar systems and orienting the radar systems and radome wall for adequate transmission. The retractable forward looking radome may be adapted for housing a mm-wave imaging radar system or may house multiple radar systems. Depending upon the application, different radome wall designs may be used. In one embodiment, a retractable forward looking radome is provided which extends from the nose portion of an aircraft having a highly pointed nose, such as a supersonic airliner. In another embodiment, a retractable forward looking radome is provided which extends from and retracts into a larger nose radome. In another embodiment, a retractable forward looking radome is provided which extends from and retracts into the lower fuselage of an aircraft.

21 Claims, 6 Drawing Sheets

RETRACTABLE FORWARD LOOKING RADOME FOR AIRCRAFT

BACKGROUND OF THE INVENTION

1. Field of the Invention

This invention relates broadly to radomes. More particularly, this invention relates to retractable forward looking radomes. The invention has particular applicability to radomes for supersonic aircraft, although it is not limited thereto.

2. State of the Art

Aircraft utilize radar to assist in navigating when visibility is decreased due to atmospheric conditions. Weather radar devices, operating within X-band at approximately 9.345 GHz, permit pilots to locate and navigate through or around stormy weather. Weather radar can locate and indicate storm conditions, but cannot provide television-type images. A synthetic vision, millimeter wave (mm-wave) imaging radar system is currently being developed which operates within W-band at 94 GHz. It has been found that at 94 GHz there is an atmospheric window which permits radar to image through fog. A narrow beam width of the 94 GHz radar is transmitted from the radar system of the aircraft through the fog. The pilot of the aircraft utilizes a heads up display (HUD) to visualize the image obtained from the 94 GHz radar. The HUD includes a pull-down transparent glass screen, similar to a sun visor, and a projector above the pilot which projects an image of the airfield onto the glass screen. The image of the HUD is boresighted (aligned) with the pilot's view of the airfield. This imaging radar is important during landing and take-off in poor visibility weather conditions and during the night, but is not required during other phases of flight.

A radome is an electromagnetic cover for the radar system of an aircraft. Different types of radomes are known. Military aircraft are often provided with retractable radomes for use with surveillance systems. For example, U.S. Pat. No. 3,754,267 to Walters et al., U.S. Pat. No. 3,766,561 to Johnson, U.S. Pat. No. 3,982,250 to Giannatto et al., and U.S. Pat. No. 4,593,288 to Fitzpatrick each disclose retractable radomes. All of the known retractable radomes are provided for military or police surveillance and are designed to scan in 360 degrees in azimuth. On commercial air transport aircraft, i.e., passenger planes, the nose of the aircraft is a radome. The radomes on a commercial air transport aircraft permit scanning only in a forward direction, and do not provide 360 degree scanning.

When a radar system is mounted onto an aircraft it is necessary to cover the system with a radome which will protect the radar system from the environment, shielding the system from heat, wind, and rain. It is also desirable for the radome to provide a light-weight housing for the system which conforms to the contours of an aircraft (if not retractable) and provides for a low aerodynamic drag shape. In satisfying these requirements, it is important that the radome not substantially adversely affect the radar when the radar energy passes through the radome and also when the reflected radar energy enters back through the radome to be received by the radar antenna.

The transmission efficiency of a radome is measured by a radome's ability to minimize reflection, distortion and attenuation of radar waves passing through the radome in one direction. The transmission efficiency is analogous to the radome's apparent transparency to the radar waves. As radomes are electromagnetic devices, transmission efficiency can be optimized by tuning the radome. The tuning of a radome is managed according to several factors, each of which is a function of the transmission frequencies of the aircraft's radar, including wall thickness, dielectric constant, and loss tangent of the materials.

A radome should have a relatively constant transmission efficiency over the scanning range of the radar system, behaving substantially the same when transmitting radar at various beam to wall angles. For example, when the radar system is transmitting and receiving out of the side of the nose of the plane, the reflection, attenuation, and distortion should not be unacceptably different than when the radar is transmitting out of the front of the nose of the plane.

Supersonic aircraft are provided with a highly pointed nose radome which may house weather radar and instrument landing system (ILS) antennas. The highly pointed nose radome has very shallow beam to radome wall incidence angles when the radar energy is transmitting out the front of the radome. The shallow beam to wall incidence angles inhibit effective transmission of mm-wave radar energy and result in strong reflection lobes. This problem is especially true for the nose radome of the High Speed Civil Transport (HSCT) Mach 2.5 supersonic airliner currently being developed by NASA and United States aircraft companies. The proposed nose design for this aircraft is highly pointed, even more so than the Concorde. With incidence angles approximately between 70° and 80° , the nose design is a radio-frequency unfriendly shape. As a result, it would be very difficult, if not impossible, to design a nose radome for this supersonic aircraft, or for any other supersonic aircraft, which would effectively house a mm-wave radar system in the same confines as the other radar systems and efficiently transmit mm-wave radar energy. In addition, X-band weather radar energy transmission is also inhibited by shallow beam to wall incidence angles. Furthermore, a new predictive wind shear detection mode available for X-band weather radar requires the use of a radome which has low side lobe and reflection lobe levels. The level of performance required for the predictive wind shear detection mode may not be possible with present radome technology for a radome designed to be the proposed shape of the nose of the HSCT.

In addition, large business jets, e.g., the GulfstreamIII, generally do not have sufficient space to house the ILS antenna and weather and imaging radar antennas, such that each of the antennas is capable of being oriented to transmit energy through the radome in a forward direction at beam to wall incidence angles which will produce adequate transmission efficiency. Also smaller business jets, e.g., the Learjet and the Cessna Citation, and commuter airliners, e.g, the DeHavilland DHC-8 and the Saab 340, do not have sufficient space available to accommodate an imaging radar antenna in addition to the existing weather radar antenna.

SUMMARY OF THE INVENTION

It is therefore an object of the invention to provide a forward looking radome for use on an aircraft having a highly pointed nose portion.

It is also an object of the invention to provide a retractable, forward looking radome.

It is another object of the invention to provide a retractable, forward looking radome assembly for use on supersonic aircraft.

It is a further object of the invention to provide a retractable, forward looking radome which can house several radar systems.

In accord with these objects which will be discussed in detail below, a retractable forward looking radome which extends from an undersurface of an aircraft is provided for housing and protecting one or more radar systems of the aircraft. The retractable radome may be designed to have a radome wall which permits high transmission for W-band and/or X-band radar energy. In first and second embodiments, a forward looking radome assembly is retractable from the highly pointed nose of an HSCT airliner. The radome assembly includes a relatively blunt, forward looking radome wall, and a weatherproof rear cover portion between which is housed either one or both of the weather band and imaging radar systems. In a third embodiment, particularly useful for large business jets, a retractable forward looking radome assembly is provided which rotates down from and retracts into the nose radome of the aircraft. In a fourth embodiment, a retractable forward looking radome assembly is provided which extends from and retract into the lower fuselage of an aircraft.

In each embodiment, the radome is intended to be extended when the aircraft is travelling at relatively slow speeds, i.e., speeds encountered during take-offs and approaches to landings (at speeds when the landing gear is also extended), and can be retracted prior to high speed flight. With particular respect to the radome adapted for an HSCT airliner, the radome is extended only when the airliner is travelling at sub-sonic speeds and is retracted prior to supersonic flight such that the radome is not subject to the high temperature and dynamic pressures of supersonic flight. Because the retractable radome assembly is only extended during relatively slow speeds, the shape of the radome wall can be relatively blunt, as compared to the nose of the aircraft on which the radome assembly is mounted, thereby reducing the transmission loss due to shallow beam to radome wall incidence angles.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
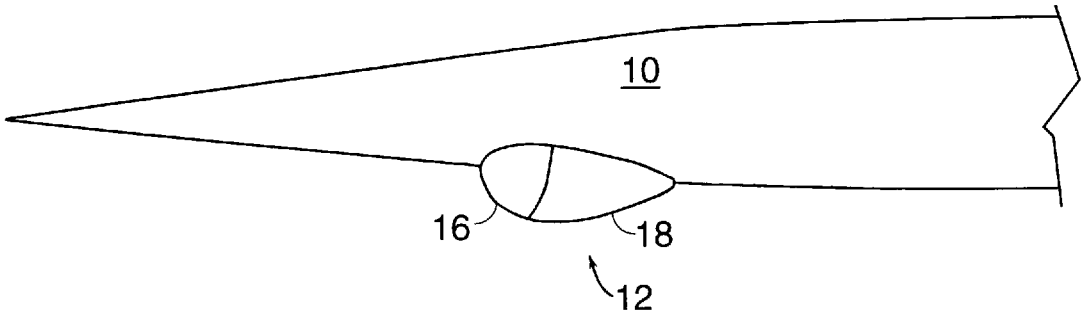
FIG. 1 is a broken side elevation view of a nose portion of a supersonic aircraft provided with a retractable, forward looking radome assembly in an extended position according to a first embodiment of the invention.
Figure 2:
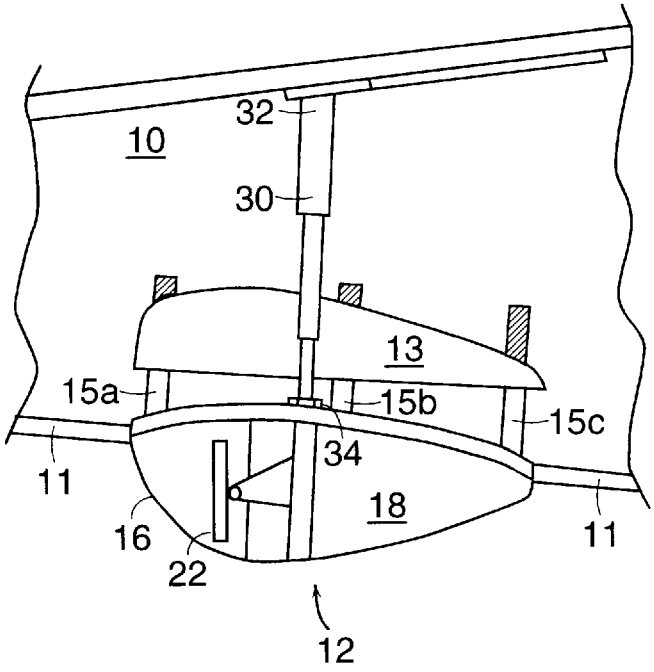
FIG. 2 is a broken side elevation in partial view, enlarged relative to FIG. 1, of the nose portion and retractable radome assembly shown in FIG. 1.
Figure 3:
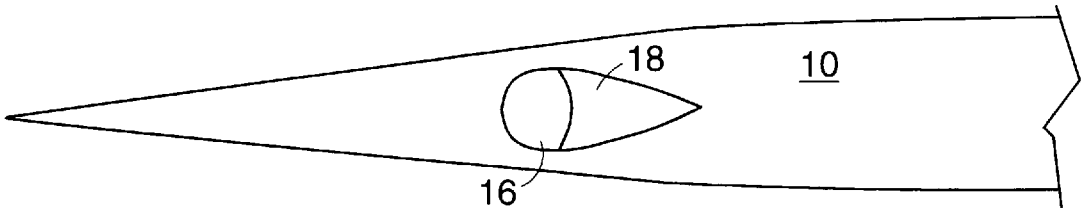
FIG. 3 is a bottom view of the nose portion and retractable, forward looking radome assembly according to a first embodiment of the invention.

Referring to FIGS. 1 through 5, the nose portion 10 of a supersonic aircraft, such as a High Speed Civil Transport (HSCT) airliner, is shown. In FIGS. 1 through 3, a retractable forward looking radome assembly 12 is shown extended (descended) through a lower wall 11 of the nose portion 10. One of a pair of nose bay doors 13 (, 14) is shown retracted along tracks 15*a,* 15*b,* 15*c* to permit the extension of the radome assembly 12.

The radome assembly 12 includes a radome wall 16 and a weatherproof rear cover portion 18 which preferably has a tapered and streamlined afterbody shape. A radar antenna 22, for example, a mm-wave imaging radar antenna, is mounted substantially behind the radome wall 16, for transmitting and receiving radar energy in a forward direction. Alternatively, multiple radar antennas, for example a weather radar antenna and an imaging radar antenna, may be housed behind the radome wall 16. As the rear cover portion 18 is not required to transmit radar energy, it may be made of variety of relatively common structural materials; for example, sheet metal or composites.

The radome wall 16 may be constructed according to one of the multi-layer designs commonly known in the art. For example, the radome may be an A-sandwich, a B-sandwich, or a C-sandwich. The radome may also be of a multi-layer design known as a D-sandwich and disclosed in co-owned U.S. Pat. No. 5,408,244, entitled "Radome Wall Design Having Broadband And MM-Wave Characteristics" or of another design as disclosed in co-owned Ser. No. 08/751,349, entitled "W-Band and X-Band Radome Wall", which are both hereby incorporated by reference herein in their entireties. The latter design provides a unitary radome wall construction which will satisfactorily transmit both weather radar and imaging radar energy.

Because the radome assembly is only extended during the subsonic portion of flight, the aerodynamic drag caused by the shape of the radome wall, while important, is not critical. As such, a blunt radome wall (blunt relative to the nose portion), and preferably substantially hemispherical when viewed from the bottom (as shown in FIG. 3), can be used. This relatively blunt shape provides superior transmission efficiency for the radome wall when compared to a more pointed radome which has more shallow beam to wall angles. A streamlined afterbody shape is provided to the rear cover portion 18 to minimize the drag created by the radome assembly when the radome assembly is in an extended position.

The radome assembly 12 is coupled to a mechanism which extends and retracts the radome assembly from and into the nose of the aircraft. A hydraulic piston 30 having one end 32 mounted to the inside of the nose portion 10 and the other end 34 mounted to the radome assembly 12 raises and lowers the radome assembly.

Figure 4:
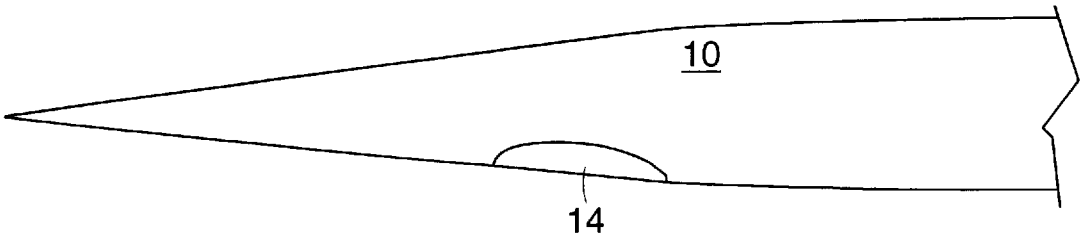
FIG. 4 is a broken side elevation view of the nose portion and retractable, forward looking radome assembly in a retracted position according to a first embodiment of the invention.
Figure 5:
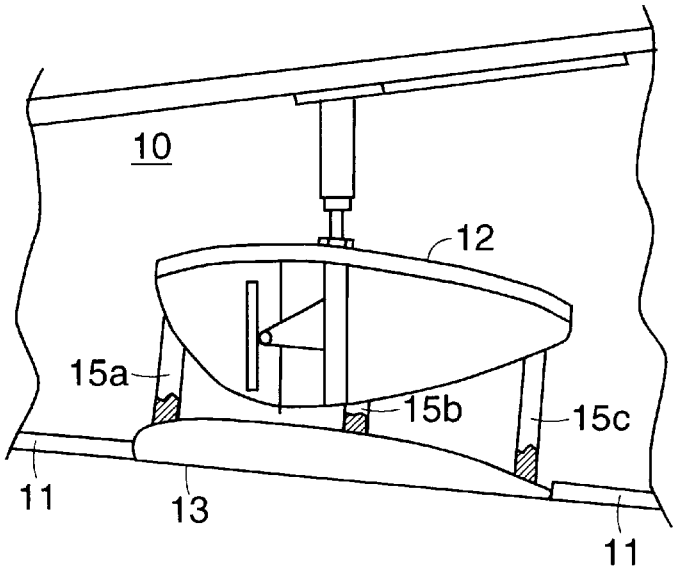
FIG. 5 is a broken side elevation in partial view, enlarged relative to FIG. 4, of the nose portion and the retractable, forward looking radome in a retracted position according to a first embodiment of the invention.
Figure 6:
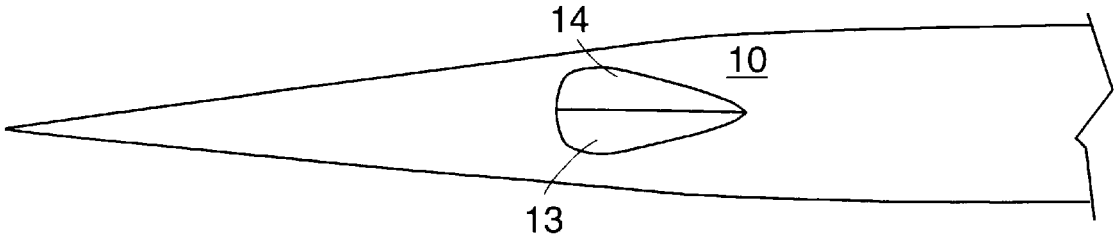
FIG. 6 is a bottom view of the nose portion with the retractable radome in a retracted position according to a first embodiment of the invention.

Turning to FIGS. 4 through 6, the radome assembly 12 is shown retracted into the nose portion 10 of the aircraft. The nose bay doors 13, 14 are moved down tracks 15*a*, 15*b*, 15*c* into a closed position such that the bay doors become contiguous with the lower wall 11 of the nose portion 10 and thereby form an outer surface suitable for high speed flight.

The radome assembly 12 may be moved into an extended position (FIGS. 1 through 3) when any radar system housed within is active, for example, during take-off and landing and subsonic ascent and descent when weather and imaging radar systems are housed therein. In addition, the radome assembly 12 may be moved into a retracted position (FIGS. 4 through 6) when the radar system is not being used, such as when the aircraft is performing at relatively high altitude and during relatively high speed flight.

Figure 7:
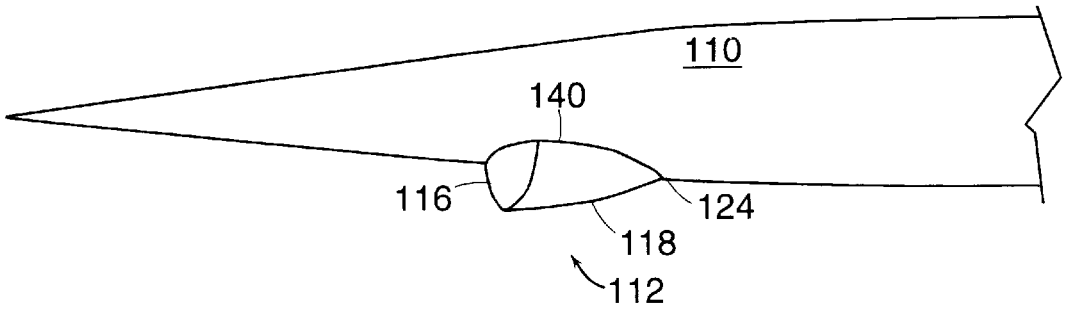
FIG. 7 is a broken side elevation in partial view of a nose portion of ar aircraft provided with a retractable, forward looking radome assembly in an extended position according to a second embodiment of the invention.
Figure 8:
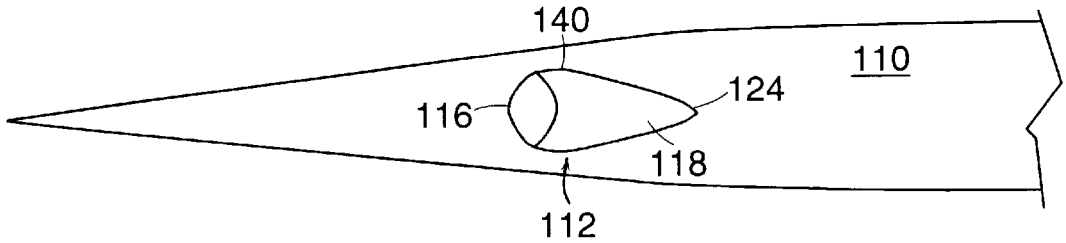
FIG. 8 is a bottom view of the nose portion and retractable, forward looking radome assembly shown in FIG. 7.
Figure 9:
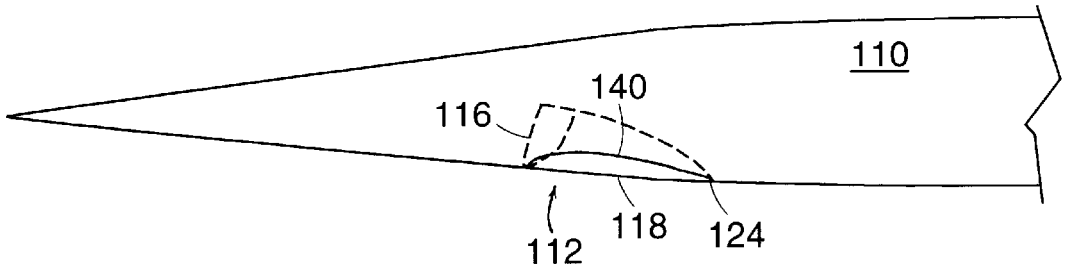
FIG. 9 is a broken side elevation view of the nose portion and retractable, forward looking radome assembly in a retracted position according to a second embodiment of the invention.

Referring to FIGS. 7 through 9, a second embodiment of a retractable radome, substantially similar to the first embodiment (with like parts having numbers incremented by 100), is shown. The radome assembly 112 descends from the nose portion 110 by rotating downward through an arc about a rear mount 124 until the radome wall 116 is adequately positioned for radar energy transmission toward the desired forward looking target areas. When the radome is in a retracted position (FIG. 9), the rear cover portion 118 forms a lower wall portion of the nose portion 110 of the aircraft. Preferably a seal 140 is provided on the nose portion to maintain a substantially weatherproof barrier between the nose portion 110 of the aircraft and the rear cover portion 118 of the forward looking radome assembly in both retracted and extended positions.

Figure 10:
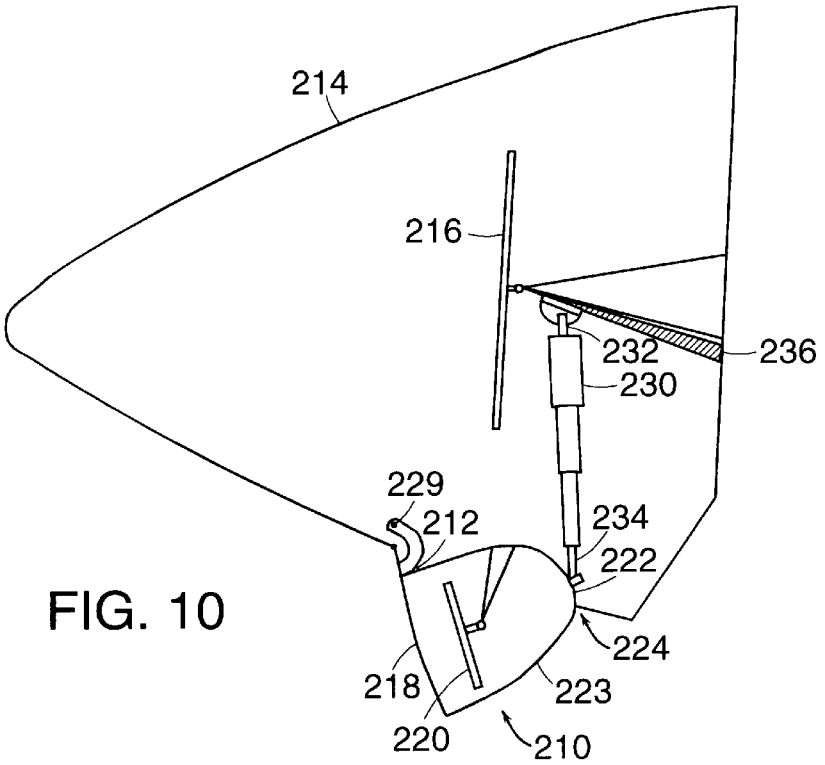
FIG. 10 is a broken side elevation in partial view of a nose radome of an aircraft provided with a retractable, forward looking radome assembly in an extended position according to a third embodiment of the invention.
Figure 11:
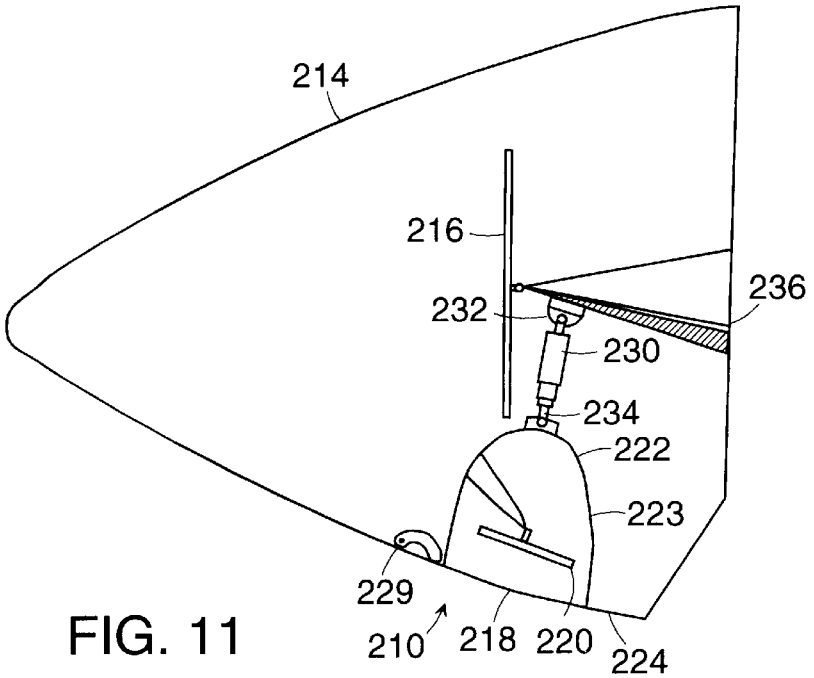
FIG. 11 is a broken side elevation in partial view of the nose radome and retractable, forward looking radome assembly shown in FIG. 10 in a retracted position.

Turning to FIGS. 10 and 11, a third embodiment of a retractable forward looking radome assembly 210 is shown. The radome assembly 210 is extendable through and retractable into an opening 212 in the nose radome 214 of an aircraft. The nose radome 214 is more blunt than the nose of the supersonic aircraft described above. The retractable radome assembly 210 includes a forward looking radome wall 218 which is preferably relatively blunt, a radar antenna 220, and a weatherproof rear cover 222. To extend the radome assembly, the radome assembly 210 is rotated, preferably through an arc, downward and forward from its generally downward facing retracted position (shown in FIG. 11) such that the radome wall 218 and the antenna 220 are oriented for transmission in a forward looking direction (shown in FIG. 10). A lower portion 223 of the weatherproof rear cover 222 is preferably arced such that as the radome assembly 210 rotates through the arc and extends down from the nose radome 214, the space between the weatherproof cover 222 and the opening 212 remains relatively small. It is also preferable that the perimeter of the opening 212 be provided with a seal 224 to maintain a substantially weatherproof barrier between the nose radome 214 of the aircraft and the weatherproof rear cover 222 of the retractable radome assembly. The radome wall 218 preferably has a contour which is substantially similar to a portion of the nose radome 214 such that when the retractable, forward looking radome assembly 210 is in a retracted position, the radome wall 218 preferably becomes contiguous with the nose radome 214 of the aircraft, as shown in FIG. 11. The radome assembly 210 is coupled to a mechanism which extends and retracts the radome assembly from and into the nose of the aircraft. Preferably the mechanism includes a rotatable hinge bracket 229 and a hydraulic piston 230. The rotatable hinge bracket 229 is coupled between the nose radome 214 and the radome assembly 210, and rotates about one of its ends. The hydraulic piston 230 has one end 232 mounted to a support bracket 236 and another end 234 mounted to the radome assembly 210. The piston 230 raises and lowers the radome assembly about the rotatable hinge bracket 229.

In one particular application, the nose radome 214 is a provided on a business jet or helicopter and houses an X-band weather radar antenna 216. The nose radome is constructed to have a high transmission efficiency for X-band radar energy. The retractable radome assembly 210 houses a mm-wave imaging radar system. The radar antenna 220 is a mm-wave radar antenna, and the radome wall 218 is designed for high transmission efficiency of mm-wave radar energy.

Figure 12:
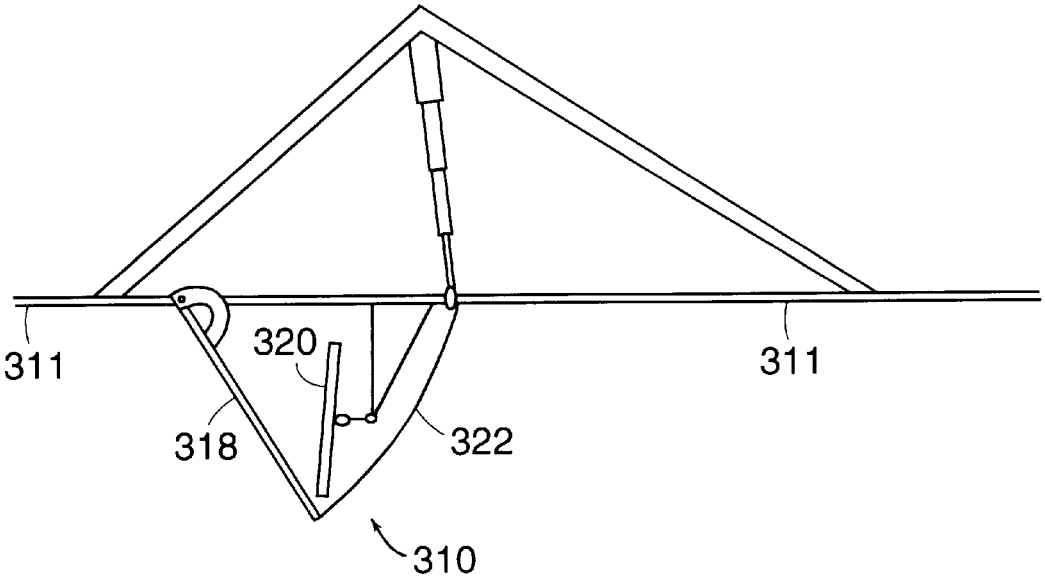
FIG. 12 is a broken side elevation in partial view of a lower fuselage of an aircraft provided with a retractable, forward looking radome assembly in an extended position according to a fourth embodiment of the invention.
Figure 13:
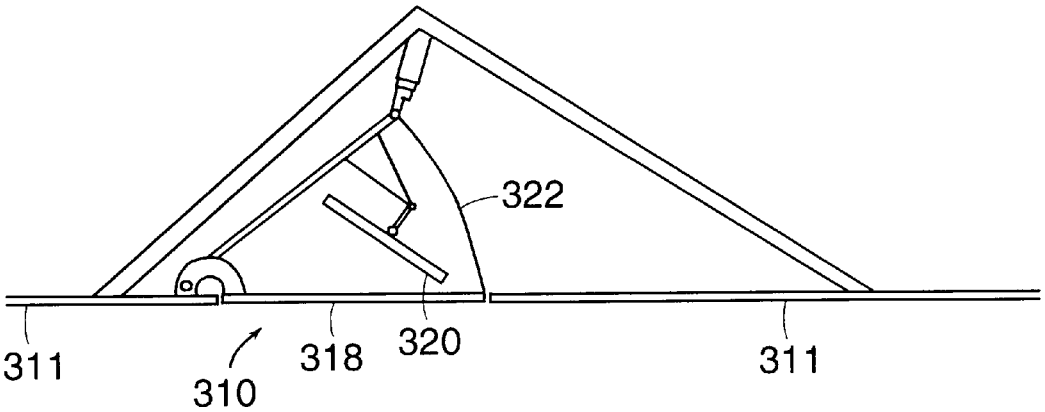
FIG. 13 is a broken side elevation in partial view of a lower fuselage of an aircraft provided with a retractable, forward looking radome assembly in a retracted position according to the fourth embodiment of the invention.

Turning to FIGS. 12 and 13, a fourth embodiment of a retractable forward looking radome assembly 310, substantially similar to the third embodiment (with like parts having numbers incremented by 100), is shown. The radome assembly 310 includes a retractable radome wall 318, a rear cover portion 322, and an antenna 320. The radome assembly 310 extends from and retracts into the lower fuselage 311 of an aircraft in a manner similar to that shown above with respect to the third embodiment, such that the radome wall becomes contiguous with the fuselage 311 and assumes the original contour of the fuselage when the radome assembly 310 is in a retracted position. The radome wall 318 is relatively blunt, preferably having a slight curve for aerodynamic purposes, but may also be of a substantially flat design.

There have been described and illustrated herein several embodiments of a retractable radome for housing a radar system. While particular embodiments of the invention have been described, it is not intended that the invention be limited thereto, as it is intended that the invention be as broad in scope as the art will allow and that the specification be read likewise. Thus, while a particular hydraulic means for retracting and extending a forward looking radome assembly has been provided, it will be appreciated that other mechanisms for retracting and extending a forward looking radome assembly may be used as well. For example, a motor may be used to raise and lower the radome assembly. Likewise, any appropriate mechanism known in the art for extending and retracting gear, lights, radomes, etc., may be used. For example, many of the means for extending a surveillance radome shown in U.S. Pat. No. 3,754,267, No. 3,766,561, No. 3,982,250, and No. 4,593,288 (which are hereby incorporated by reference herein in their entireties) may be used. In addition, while particular radome wall designs have been referred to herein, it will be appreciated that other radome wall designs may be used and that the optimum radome wall design for the intended application should preferably be used. Furthermore, while the several embodiments of a retractable, forward looking radomes have been described as being extendable out of and retractable into a portion of a lower surface of an aircraft, it will be appreciated that the retractable radome may extend from and retract into an upper surface of an aircraft. Moreover, while the invention has been described in particular embodiments with reference to 94 GHz imaging radar, a 35 GHz (Ka-band) imaging radar is currently under consideration. It will be appreciated that the invention may be used with any imaging radar system, currently available or yet to be developed. In addition, it will be appreciated that the retractable, forward looking radome assembly may be used on aircraft of types other than described above. For example, a retractable, forward looking radome according to the invention may be provided on helicopters. It will therefore be appreciated by those skilled in the art that yet other modifications could be made to the invention without deviating from its spirit and scope as so claimed.

We claim:

1. A retractable, forward looking radome assembly for use on an aircraft having a nose and forward and aft portions, comprising:

a) a radome having a radome wall having relatively high transmission efficiency for radar energy, and a rear cover means having relatively low transmission efficiency for radar energy and coupled to said radome wall; and b) means for moving said radome from a retracted position substantially inside the aircraft to an extended position substantially outside the aircraft to form a blister-shaped protrusion on the outside surface of the aircraft and back into said retracted position, said blister-shaped protrusion having a cross-sectional area in a plane generally parallel to the aircraft surface, wherein the cross-sectional area does not increase with increasing distance from the aircraft surface, and wherein when said radome is in said extended position said radome wall is oriented to pass radar in a generally forward direction only.

2. A retractable, forward looking radome assembly according to claim 1, wherein:

said radome wall is blunt relative to the nose of the aircraft.

3. A retractable, forward looking radome assembly according to claim 1, wherein:

said radome wall has a substantially hemispherical shape.

4. A retractable, forward looking radome assembly according to claim 1, wherein:

said radome wall is adapted to transmit imaging radar energy.

5. A retractable, forward looking radome assembly according to claim 4, wherein:

said radome wall is further adapted to also transmit weather radar energy.

6. A retractable, forward looking radome assembly according to claim 1, further comprising:

c) at least one radar antenna mounted within said radome assembly such that said radome wall and said rear cover means substantially completely surround said radar antenna.

7. A retractable, forward looking radome assembly according to claim 1, wherein:

said rear cover means is provided with a tapered aerodynamically streamlined afterbody shape.

8. A retractable, forward looking radome assembly according to claim 1, wherein:

said rear cover means includes a portion which is contiguous with the outside surface of the aircraft when said radome is in said retracted position.

9. A retractable, forward looking radome assembly according to claim 1, wherein:

said rear cover means is made of at least one of sheet metal and a composite material.

10. A retractable, forward looking radome assembly according to claim 1, wherein:

said means for moving said radome moves said radome in an arc.

11. A retractable forward looking radome assembly according to claim 1, wherein:

said means for moving said radome includes a hydraulic piston.

12. A retractable, forward looking radome assembly according to claim 1, further comprising:

c) seal means coupled to the aircraft and in contact with said rear cover means when said radome is in said extended position.

13. A multi-radome assembly for an aircraft, comprising:

a) a first radome having a first radome wall coupled to the aircraft;

b) a second radome having a second radome wall; and c) means for moving said second radome from a retracted position substantially inside said first radome to an extended position substantially outside said first radome to form a blister-shaped protrusion on the outside surface of the aircraft, said blister-shaped protrusion having a cross-sectional area in a plane generally parallel to the aircraft surface, and wherein the cross-sectional area does not increase with increasing distance from the aircraft surface.

14. A multi-radome assembly according to claim 13, wherein:

said second radome wall includes a portion which is contiguous with said first radome wall when said second radome assembly is in said retracted position.

15. A multi-radome assembly according to claim 13, further comprising:

d) a first antenna which transmits first radar energy through said first radome wall; and e) a second antenna which transmits second radar energy through said second radome wall.

16. A multi-radome assembly according to claim 15, wherein:

said first antenna is a weather band antenna and said first radar energy is weather band radar energy, and said first radome wall is adapted to have a high transmission efficiency for weather band radar energy, and said second antenna is an imaging radar antenna, said second radar energy is imaging radar energy, and said second radome wall is adapted to have a high transmission efficiency for imaging radar energy.

17. A multi-radome assembly according to claim 15, wherein:

said second radome wall is substantially forward of said second radar antenna when said second radome is in said extended position.

18. A multi-radome assembly according to claim 17, wherein:

said second radome further includes a rear cover substantially behind said second radar antenna when said second radome is in said extended position, said rear cover having a low transmission efficiency for radar energy relative to said second radome wall.

19. A multi-radome assembly according to claim 18, wherein:

said rear cover is provided with an arc shaped portion.

20. A multi-radome assembly according to claim 18, further comprising:

d) seal means coupled to the aircraft and in contact with said rear cover means when said radome is in said extended position.

21. A multi-radome assembly according to claim 13, wherein: said first radome is a nose radome.

* * * * *